US005354256A

United States Patent [19]

Knelson

[11] Patent Number: 5,354,256

[45] Date of Patent: Oct. 11, 1994

[54] APPARATUS FOR SEPARATING INTERMIXED MATERIALS OF DIFFERENT SPECIFIC GRAVITY

[76] Inventor: Benjamin V. Knelson, 20321-86th Avenue, R.R.#11, Langley, British Columbia, Canada, V3A 6Y3

[21] Appl. No.: 53,259

[22] Filed: Apr. 28, 1993

[51] Int. Cl.[5] ..... B04B 1/04

[52] U.S. Cl. ..... 494/80; 494/56; 494/63; 209/453

[58] Field of Search ..... 209/270, 274, 278, 453; 494/43, 60, 80, 27, 28, 29, 30, 45

[56] References Cited

U.S. PATENT DOCUMENTS

| | | | |
|---|---|---|---|
| 4,115,278 | 9/1978 | Fritsch | 494/80 X |
| 4,265,743 | 5/1981 | Younge | 209/452 |
| 4,347,130 | 8/1982 | Younge | 209/452 |
| 4,361,480 | 11/1982 | Corbus et al. | 494/80 X |
| 4,608,040 | 8/1986 | Knelson | 494/80 X |
| 4,846,781 | 7/1989 | Knelson | 494/27 |
| 4,983,156 | 1/1991 | Knelson | 494/80 X |
| 5,190,160 | 3/1993 | Murphy et al. | 209/270 |

FOREIGN PATENT DOCUMENTS 0098909 8/1898 Fed. Rep. of Germany ..... 494/80

*Primary Examiner*—D. Glenn Dayoan
*Assistant Examiner*—Tuan N. Nguyen
*Attorney, Agent, or Firm*—Adrian D. Battison; Stanley G. Ade; Murray E. Thrift

[57] ABSTRACT

An enhanced gravity laminar flow separation system is provided by a conical drum which has a plurality of flow channels along the inside surface of the drum. Feed material for separation is fed into the drum and accelerated by an impeller so as to enter the channels at a feed end at the base of the drum and to move along the channels to a discharge end at the mouth of the drum of increased diameter. Heavies are stripped from the base of the channel and the lights escape from the open mouth of the bowl longitudinally of the channel. The channel changes cross-section from the feed end to the discharge end decreasing in width and increasing in depth by the addition of a V-groove at the base. Tangential forces from the acceleration of the material which act on one side of the channel are balanced by the shape of the channel to provide symmetrical flow.

17 Claims, 3 Drawing Sheets

APPARATUS FOR SEPARATING INTERMIXED MATERIALS OF DIFFERENT SPECIFIC GRAVITY

This application relates to an apparatus for separating intermixed materials of different specific gravity which uses a rotating drum to enhance the gravitational forces effecting separation.

Apparatus for separating intermixed materials are well-known which use a centrifugal drum into which the materials are fed. Generally devices of this type include a peripheral wall of the drum over which the materials run with a suitable shaping of the surface so that the heavier materials collect within the drum while the lighter materials wash across the surface of the drum and are discharged from the open mouth of the drum. One example of a device of this type if shown in U. S. Pat. No. 4,846,781 of the present inventor.

Centrifugal separators of the above general type are often used in separating gold-bearing or other heavy materials from a slurry containing the materials intermixed with other minerals. It is necessary in such separation techniques that relatively large quantities of the product pass through the separator.

Most of the separators of this general type are of a batch type in that the heavy materials collect in the centrifuge bowl and the system needs to be halted periodically to extract or collect the heavier materials from the bowl while the feed is temporarily halted.

Older types of separation for use in mining or similar heavy metal separation techniques involve various types of sluices which separate using only single gravity to separate the materials. One type of single gravity separation technique of this type is known as a pinch sluice in which the material runs along a channel which is generally rectangular in cross-section with a flat base and vertical side walls. At the commencement of the sluice, the channel may have a width of 27 inches and a depth of 6 to 8 inches. The channel then changes in cross-section so that its width gradually decreases from the feed end toward the discharge end and the depth gradually increases. This generates a laminar flow of the materials which gradually causes the heavier materials to settle toward the bottom of the sluice. This technique of the pinch sluice has been available since the last century. It does however require a very large channel in order to accommodate the volumes of material to be separated and it operates only on the separating force of a single gravity.

SUMMARY OF THE INVENTION

It is one object of this invention to provide an improved separating system which can continually extract the heavier materials from the lighter materials but provides an improved separation action and can be effect in a relatively small apparatus to avoid the large construction necessary for the pinch sluice.

According to the invention, therefore there is provided an apparatus for separating intermixed materials of different specific gravity comprising a drum having a peripheral wall surrounding a central axis of the drum and defining an inner surface facing inwardly toward the central axis; means mounting the drum for rotation about the central axis; the inner surface of the peripheral wall increasing in radius relative to the central axis from one axial end to an opposed axial end of the peripheral wall; means defining a plurality of angularly spaced channels on the inner surface each channel extending from the feed end at said one axial end of the peripheral wall to a discharge end of the opposed axial end of the peripheral wall; means for feeding the intermixed materials into the drum at said one end of the peripheral wall and arranged to direct the materials into the channels at the feed end thereof such that a portion of the intermixed materials enters each of the channels to flow therealong to the discharge end thereof; each channel having a base and two sides defining a cross-section of the channel, the cross-section of the channel varying along the length of the channel such that a transverse width of the channel angularly of the peripheral wall decreases and a depth of the channel radially of the peripheral wall increases along the channel from the feed end toward the discharge end thereof, a first opening in the base at the discharge end for release of heavier materials and a second discharge opening from the channel for discharge of remaining materials after the heavier materials have discharged through the first opening; first collecting means for receiving the heavier materials from the first discharge openings of the channels and second collecting means for receiving the remaining materials discharged from the second discharge openings of the channels.

According to a second aspect of the invention there is provided a method for separating intermixed materials of different specific gravity comprising providing a drum having a peripheral wall surrounding a central axis of the drum and defining an inner surface facing inwardly toward the central axis; rotating the drum for rotation about the central axis; defining the inner surface of the peripheral wall such that it increases in radius relative to the central axis from one axial end to an opposed axial end of the peripheral wall; defining a plurality of angularly spaced channels on the inner surface each channel extending from the feed end at said one axial end of the peripheral wall to a discharge end of the opposed axial end of the peripheral wall; feeding the intermixed materials into the drum at said one end of the peripheral wall and directing the materials into the channels at the feed end thereof such that a portion of the intermixed materials enters each of the channels to flow therealong to the discharge end thereof; providing on each channel a base and two sides defining a cross-section of the channel, the cross-section of the channel varying along the length of the channel such that a transverse width of the channel angularly of the peripheral wall decreases and a depth of the channel radially of the peripheral wall increases along the channel from the feed end toward the discharge end thereof, discharging heavier materials through a first opening in the base at the discharge end and providing a second discharge opening from the channel for discharge of remaining materials after the heavier materials have discharged through the first opening.

One embodiment of the invention will now be described in conjunction with the accompanying drawings in which:

DETAILED DESCRIPTION

Figure 1:
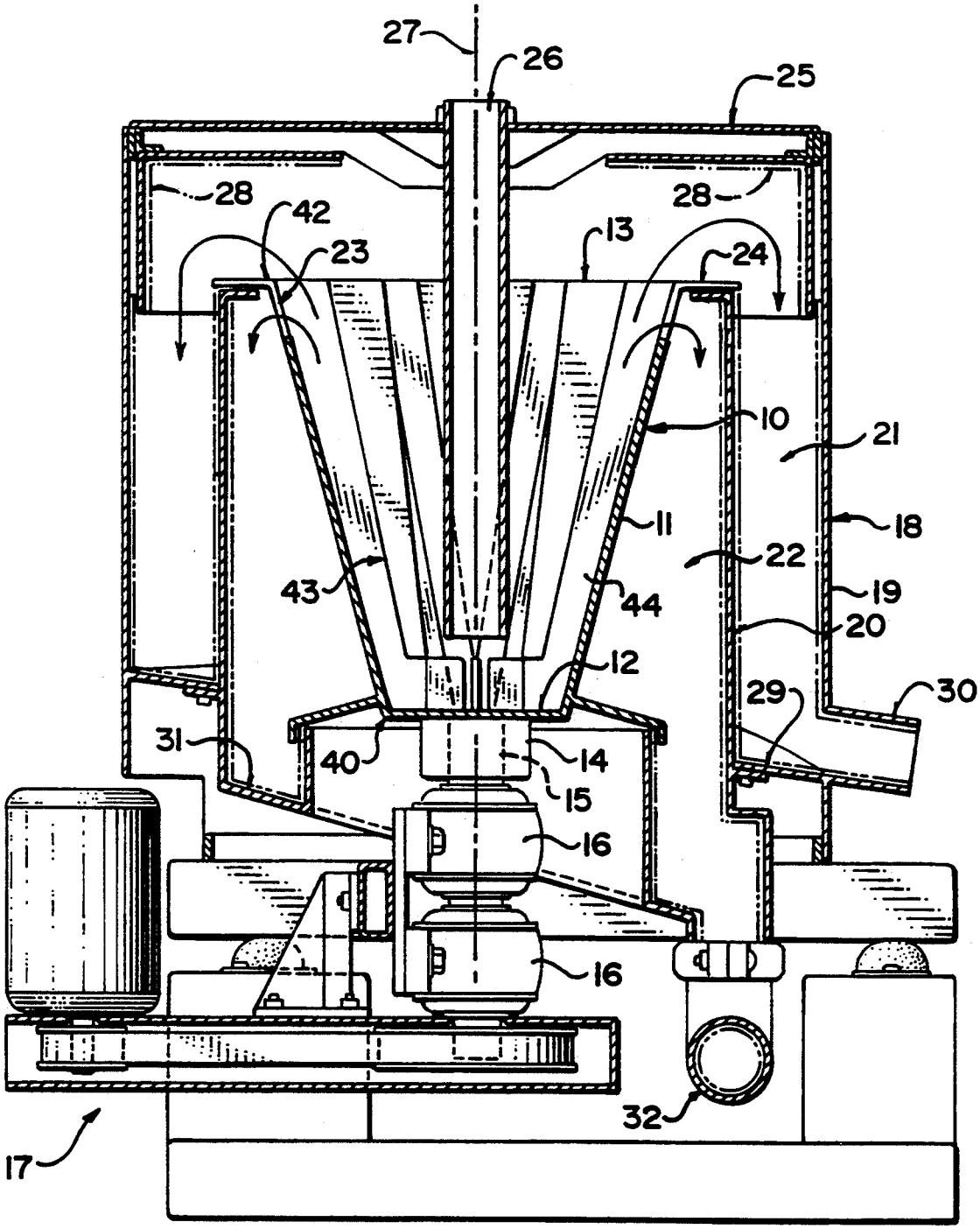
FIG. 1 is a vertical cross-sectional view through the apparatus according to the present invention.

The separation apparatus is shown mainly in FIG. 1 and comprises a drum 10 having a peripheral wall 11 and base wall 12, both of which are closed to form a receptacle with an open top 13. The base 12 is mounted on a boss 14 driven by a shaft 15 carried on bearings 16 and driven by a motor and drive belt assembly 17. The bowl is mounted within a housing 18 having an outer housing wall 19 which is cylindrical and an inner housing wall 20 which is similarly cylindrical and lying coaxially inside the outer housing wall 19. This arrangement forms an annular launder 21 for receiving materials discharged through the open mouth 13 of the drum. The inner housing wall 20 defines an inner launder 22 for receiving heavier materials discharged through openings 23 in the peripheral wall 11. An interconnecting flange arrangement 24 separates the inner launder 22 from the outer launder 21. A circular cover 25 extends over the outer housing wall 19 so as to form a closure therefor. The cover 25 covers a feed tube 26 extending vertically downwardly therefrom at a central position lying on the central axis 27 of the drum, the feed tube 26 extending from the cover downwardly to a position closely adjacent the base 12. The cover further carries a liner 28 which engages the material escaping from the mouth 13 of the bowl to ensure that this properly turns downwardly into the outer launder 21. The base of the outer launder is provided an inclined base wall 29 which directs the material in the launder downwardly to an outlet 30 from which the lighter separated material can be collected. Similarly the inner launder 22 includes an inclined base wall 31 which directs the material exiting from the openings 23 downwardly to a collecting duct 32.

Figure 2:
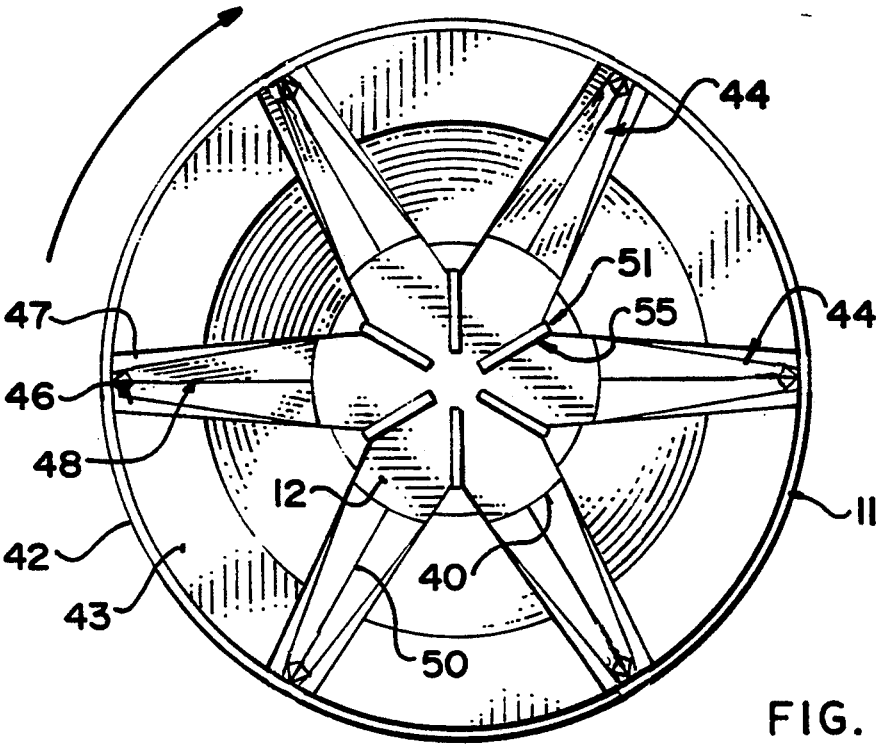
FIG. 2 is a top plan view of the centrifuge drum of FIG. 1 with the feed tube omitted for convenience of illustration.
Figure 4:
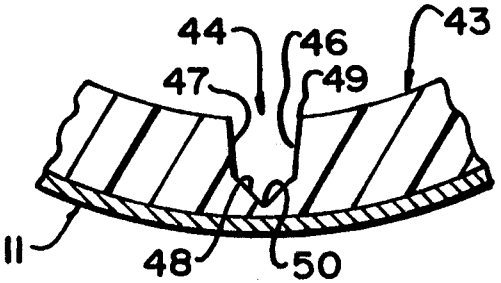
FIGS. 3 and 4 are transverse cross-sectional views through a single channel at the inlet end and discharge end respectively.
Figure 3:
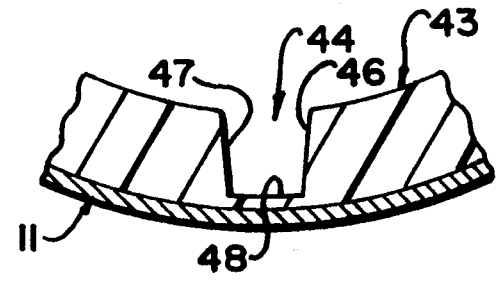

The structure of the bowl is shown in FIGS. 1, 2, 3 and 4. Thus the bowl includes the peripheral wall 11 which is frusto-conical in shape extending from a first radius 40 at the base gradually increasing in radius to the upper end at the mouth as indicated at 42. The inclination of the wall is constant so it gradually increases in radius from the central axis 27. The frusto-conical wall 11 and the base 12 are both formed from a thin rigid material which is metal providing a structural support for the drum. Inside the drum is cast a layer of a resilient plastics material such as urethane indicated at 43. This layer is attached to the drum for rotation with the drum. Within the layer is formed a plurality of channels 44 which extend from the base 12 upwardly to the open mouth. Each channel has a feed end at the base and discharge end at the open mouth, the discharge end allowing material in the channel to escape longitudinally of the channel so that the channel is open at the upper mouth. The channels are thus in effect defined by raised vanes which are formed from the plastics material and extend inwardly from the inside surface of the drum. The cross-sectional shape of each channel is shown in FIGS. 3 and 4. In FIG. 3 is shown the cross-section of the channel at the bottom end which is the feed end of the channel and the cross-section at the discharge end is shown in FIG. 4. At both ends the channel includes two sides 46 and 47 and a base 48. The thickness of the urethane layer 43 is such that the base is formed in the urethane and is just spaced from the inside surface of the wall 11. The cross-section of the channel is such that it gradually changes from the shape shown in FIG. 3 to the shape shown in FIG. 4. As will be observed from the drawings, the base 48 at the feed end is substantially flat and parallel to the wall 11. The base thus faces directly inwardly toward the axis 27. The side walls 46 and 47 extend generally directly upwardly from the base and thus lie essentially in axial planes of the axis 27. However as shown the sides may be inclined slightly outwardly so that the channel is wider at its inner surface adjacent the axis 27 than at its base. The channel is open as shown to allow the material to enter the channel and then to move longitudinally of the channel. At the discharge end shown in FIG. 4, the base includes a V-shape with an apex centrally of the sides 46 and 47 with the apex spaced further outwardly from the open mouth 49 of the channel so that the channel is of greater depth in the radial direction. At the same time the space between the sides 46 and 47 is reduced at the discharge end so the channel becomes gradually narrower as shown in FIG. 2. Thus the channel decreases in width in the angular direction and increases in depth by the addition of the V-shape in the base along the apex. The V-shape commences at or closely adjacent the inlet end shown in FIG. 3 but is so shallow in FIG. 3 that it is not visible. However the apex is visible in FIG. 2 as indicated at 50. The number of channels is effectively the maximum that can be provided in the bowl with the channels just touching at the base of the bowl, that is the sides meet at an apex 51 at the base of the bowl, As shown in FIG. 2, the channels then extend along the peripheral wall of the bowl in an axial plane of the axis 27.

Each channel has an outlet 23 extending through the base at the discharge end. The outlet is generally diamond-shaped and is covered by an adjustment plate 53 which also includes an opening therethrough which can be aligned with the opening 23. Movement of the adjustment plate 53 in a direction longitudinal of the bowl thus increases or decreases the size of the opening 23 to vary the amount of material escaping from the base of the channel at the discharge end. The size of the opening is thus selected to extract a required proportion of the material through the opening 23. The remaining quantity of material moves along the channel and escapes directly through the open upper end of the channel at the wall 11 and thus enters the area above the bowl beyond the open mouth 13 before entering the outer launder.

The shape of the channel which varies so it becomes gradually narrower and gradually deeper toward the discharge end causes a laminar flow of the materials within the channel so the heavier material gradually moves to the base of the channel for escaping through the opening 23.

The material fed through the feed tube 26 is deposited onto an impeller 55 mounted on the base 12. The impeller includes a plurality of radial fins which engage feed material and accelerate it to the speed of the bowl. The arrangement of the blades of the impeller is such that the material is divided into separate portions which are then fed each into a respective channel for movement therealong. The amount of the feed is thus arranged so that the feed enters the channels and is not otherwise carried on the inner surface of the bowl. There is therefore no feed passing over the channels but only the feed which is proportioned by the impeller and directed into the channels to move along the channels.

The feed is thus deposited into the bowl and continuously separated into the heavier portions delivered to the outlet 32 and the lighter gangue delivered to the outlet 30.

It is appreciated that the increasing radius of the bowl toward the discharge end of the channel requires the material in the channel to be accelerated in an angular direction. The rotation of the bowl applies a significant G-force on the material pressing it against the base of the channel. This improves the separation effect significantly relative to a single G-force separation. The increasing radius of the bowl is necessary to drive the material along the channel so that the material is also accelerated in the axial direction by the inclination outwardly of the base of the channel. This increasing radius of the channel also requires the material to be accelerated in the angular direction and thus there is pressure on the material from the side 46 which is the angularly retarded side of the channel relative to the direction of rotation shown in FIGS. 3 and 4. The side 46 thus pushes against the material to provide the angular acceleration necessary for the material to move radially outwardly and to move upwardly of the bowl.

At the same time as there is increased force on the side 46 of the channel there is a decreased force on the side 47 of the channel so the forces on the materials are not symmetrical. For best operation of the device it is preferred that the channel be designed so that the forces on the material in the channel are symmetrical that is the majority of the forces are directed outwardly on the material toward the base 48.

Figure 6:
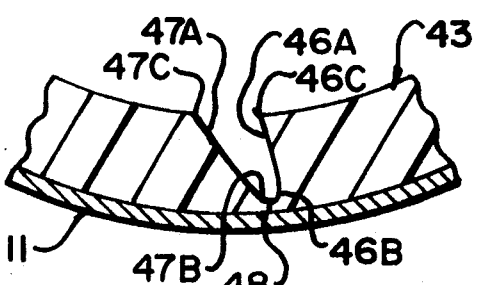
FIGS. 5 and 6 show cross-sections through alternative shape of channel at the inlet end and discharge end respectively.
Figure 5:
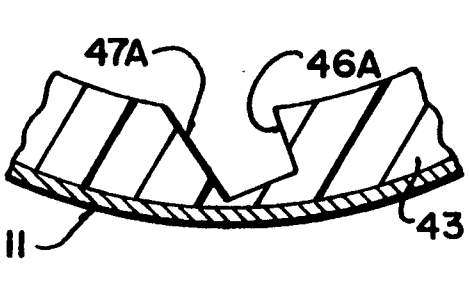

The arrangement shown in FIGS. 5 and 6 is therefore modified so that the sides 46A and 47A are inclined to an axial plane. First the side 46A is inclined so that a point 46B on that wall which is adjacent the base 48 is angularly retarded relative to a point 46C at the open mouth of the channel. It will be appreciated that an inclination of the wall 46A in this manner reduces the effect of the centrifugal force applying pressure to that wall so this is balanced relative to the tangential forces generated by the acceleration of the material in the channel at it moves longitudinally of the channel. Similarly the forces on the wall 47A are balanced by increasing the effect of centrifugal forces on this wall by its inclination such that the point 47B on the wall adjacent the base is angularly retarded relative to a point 47C at the open mouth. The inclination of the walls 46A and 47A is substantially constant along the length of the channel as will be apparent from a comparison of FIGS. 5 and 6.

Figure 8:
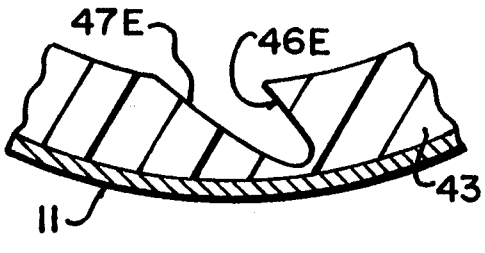
FIGS. 7 and 8 show cross-sections through a yet further alternative shape of channel at the inlet end and discharge end respectively.
Figure 7:
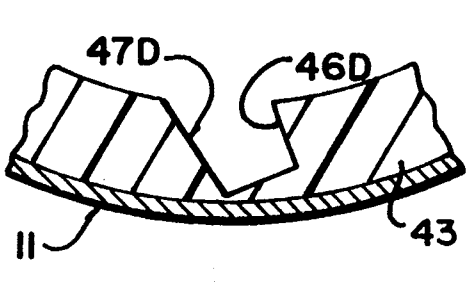

FIGS. 7 and 8 show an arrangement which is similar to that of FIGS. 5 and 6 except it is modified in that the angle of the side walls 46D and 47D commences at the feed end at the same angle as that shown in FIG. 5 but the angle as indicated at 46E and 47E increases toward the discharge end.

Figure 9:
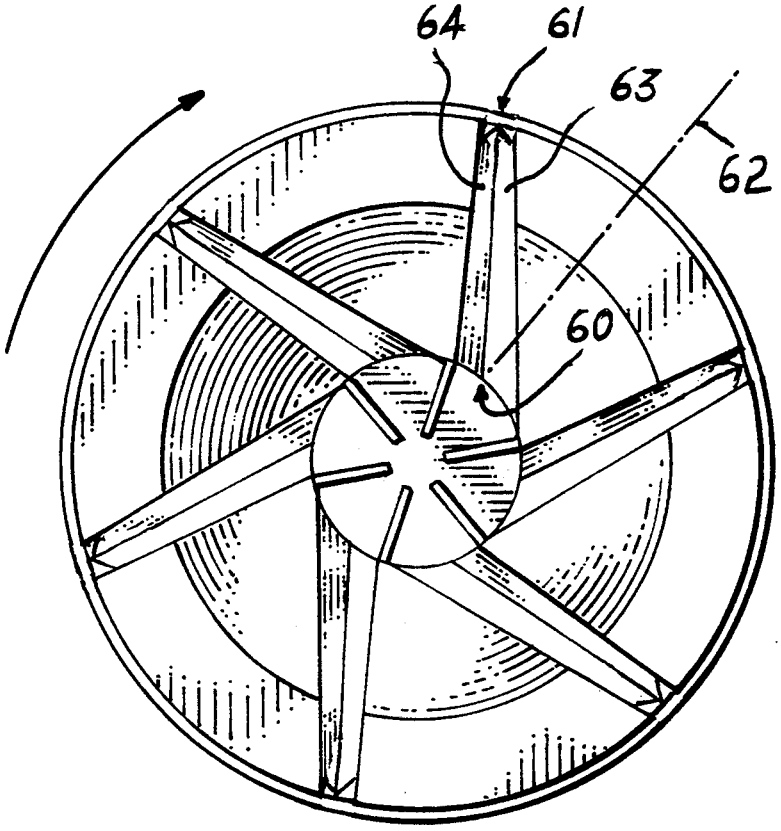
FIG. 9 is a top plan view similar to that of FIG. 2 showing alternative arrangement of the channels within the drum.

In FIG. 9 is shown an alternative arrangement for balancing the forces on the sides of the channel. In the arrangement shown in FIG. 9 the channel as a whole is inclined so that the feed end is angularly advanced relative to the discharge end. In FIG. 9, therefore, the feed end of a channel is indicated at 60 and the discharge end is indicated at 61. This inclination of the channel relative to an axial plane indicated at 62 acts to increase pressure on the side 63 of the channel while reducing the pressure on the side 64 so again to balance the pressures on these side walls, Preferrably it will be appreciated that it is necessary to balance the side pressures in order to achieve symmetrical laminar flow of the materials along the channel. The channel may also be curved so as to vary the amount of inclination from the axial plane if necessary to improve the symmetry of the faces.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. Apparatus for separating intermixed materials of different specific gravity comprising a drum having a peripheral wall surrounding a central axis of the drum and defining an inner surface facing inwardly toward the central axis;

means mounting the drum for rotation about the central axis;

the inner surface of the peripheral wall increasing in radius relative to the central axis from one axial end to an opposed axial end of the peripheral wall;

means defining a plurality of angularly spaced channels on the inner surface each channel extending from a feed end at said one axial end of the peripheral wall to a discharge end of the opposed axial end of the peripheral wall;

means for feeding the intermixed materials into the drum at said one end of the peripheral wall and arranged to direct the materials into the channels at the feed end thereof such that a portion of the intermixed materials enters each of the channels to flow therealong to the discharge end thereof;

each channel having a base and two sides defining a cross-section of the channel, the cross-section of the channel varying along the length of the channel such that a transverse width of the channel angularly of the peripheral wall decreases and a depth of the channel radially of the peripheral wall increases along the channel from the feed end toward the discharge end thereof, a first opening in the base at the discharge end for release of heavier materials and a second discharge opening from the channel for discharge of remaining materials after the heavier materials have discharged through the first opening;

first collecting means for receiving the heavier materials from the first discharge openings of the channels and second collecting means for receiving the remaining materials discharged from the second discharge openings of the channels.

2. The apparatus according to claim 1 wherein the base of each channel is substantially flat at the feed end and is substantially V-shaped at the discharge end with the shape of the channel therebetween graduating.

3. The apparatus according to claim 1 wherein the peripheral wall is frusto-conical.

4. The apparatus according to claim 1 including an impeller in the drum for engaging the feed intermixed materials entering the drum to accelerate the materials to the angular velocity of the drum and to guide the materials to the channels.

5. The apparatus according to claim 4 wherein the drum includes a closed base, the intermixed said materials being fed vertically downwardly to the closed base, the impeller being mounted on the closed base.

6. The apparatus according to claim 1 wherein the drum includes a rigid outer shell and an inner liner of a cast resilient plastics material, the channel being formed in the cast resilient plastics material.

7. The apparatus according to claim 1 wherein the first discharge opening is arranged in the peripheral wall such that the heavier materials discharge radially outwardly therefrom and wherein the second discharge opening is arranged such that remaining materials discharge longitudinally from the channel.

8. The apparatus according to claim 1 wherein each channel is shaped and arranged in cross-section so as to reduce the forces on the materials in the channel from that side of the channel which is angularly retarded relative to the direction of rotation of the drum, the forces being caused by angular acceleration of the materials as the channel increases in radius from the central axis.

9. The apparatus according to claim 8 wherein the channel is shaped and arranged in cross-section so as to substantially equalize the forces on the materials from the sides of the channel.

10. The apparatus according to claim 1 wherein each channel is shaped and arranged such that the side of the channel which is angularly retarded has at least a portion thereof which is inclined relative to a radius of the axis such that a point on the side which point is adjacent the base is angularly retarded relative to a point on the side which point is remote from the base.

11. The apparatus according to claim 10 wherein the side of the channel which is angularly retarded is shaped and arranged such that the inclination relative to the radius increases along the length of the channel from the feed end to the discharge end.

12. The apparatus according to claim 10 wherein the side of the channel which is angularly advanced has at least a portion thereof which is inclined relative to the radius of the axis such that a point on the advanced side which point is adjacent the base is angularly advanced relative to a point on the advanced side which point is remote from the base.

13. The apparatus according to claim 1 wherein each channel is arranged such that the channel is inclined to a line extending along the peripheral wall lying in an axial plane of the axis so that the feed end of the channel is angularly advanced relative to the discharge end of the channel.

14. The apparatus according to claim 13 wherein the channel is shaped such that the degree of inclination of the channel relative to the line increases so that the channel is curved.

15. A method for separating intermixed materials of different specific gravity comprising providing a drum having a peripheral wall surrounding a central axis of the drum and defining an inner surface facing inwardly toward the central axis;

rotating the drum for rotation about the central axis;

defining the inner surface of the peripheral wall such that it increases in radius relative to the central axis from one axial end to an opposed axial end of the peripheral wall;

defining a plurality of angularly spaced channels on the inner surface each channel extending from a feed end at said one axial end of the peripheral wall to a discharge end of the opposed axial end of the peripheral wall;

feeding the intermixed materials into the drum at said one end of the peripheral wall and directing the materials into the channels at the feed end thereof such that a portion of the intermixed materials enters each of the channels to flow therealong to the discharge end thereof;

providing on each channel a base and two sides defining a cross-section of the channel, the cross-section of the channel varying along the length of the channel such that a transverse width of the channel angularly of the peripheral wall decreases and a depth of the channel radially of the peripheral wall increases along the channel from the feed end toward the discharge end thereof, discharging heavier materials through a first opening in the base at the discharge end and providing a second discharge opening from the channel for discharge of remaining materials after the heavier materials have discharged through the first opening.

16. The method according to claim 15 including shaping each channel in cross-section so as to reduce the forces on the materials in the channel from that side of the channel which is angularly retarded relative to the direction of rotation of the drum, the forces being caused by angular acceleration of the materials as the channel increases in radius from the central axis.

17. The method according to claim 16 wherein the channel is shaped and arranged in cross-section so as to substantially equalize the forces on the materials from the sides of the channel.

* * * * *